United States Patent [19]

Mackie

[11] 4,255,856

[45] Mar. 17, 1981

[54] UTILITY KNIFE ATTACHMENT

[76] Inventor: Malcolm Mackie, Box 787, Stayner, Canada

[21] Appl. No.: 93,552

[22] Filed: Nov. 13, 1979

[51] Int. Cl.[3] ..... B26B 11/00; B26B 1/08

[52] U.S. Cl. ..... 30/293; 7/163

[58] Field of Search ..... 7/163, 164; 30/317, 30/310, 293, 294, 289; 33/138, 137 R, 137 L, 288, 289

[56] References Cited

U.S. PATENT DOCUMENTS

| | | | |
|---|---|---|---|
| 786,646 | 4/1905 | Johnson | 7/163 |
| 1,218,798 | 3/1917 | Nelson | 7/163 |
| 1,684,566 | 9/1928 | Winkler | 33/137 R |
| 1,843,535 | 2/1932 | Arnold | 30/293 |
| 2,023,408 | 12/1935 | Coll | 7/164 |
| 2,023,409 | 12/1935 | Coll | 7/163 |
| 2,211,577 | 8/1940 | Muserlian | 33/137 R |
| 2,952,025 | 9/1960 | Johnson | 7/163 |

FOREIGN PATENT DOCUMENTS

| | | | |
|---|---|---|---|
| 11333 | of 1911 | United Kingdom | 33/138 |

*Primary Examiner*—Othell M. Simpson
*Assistant Examiner*—Roscoe V. Parker
*Attorney, Agent, or Firm*—Rogers, Bereskin & Parr

[57] ABSTRACT

An attachment for a utility knife is disclosed which allows the knife to be used in association with a measuring tape for cutting sheets of plasterboard and the like into uniform widths. In one embodiment, the attachment is in the form of a relatively thin metal plate which is fitted into the handle of the knife alongside the blade and which has a projecting flange at its outer end formed with a slot for receiving a measuring tape.

7 Claims, 3 Drawing Figures

UTILITY KNIFE ATTACHMENT

This invention relates to an attachment for utility knives designed to facilitate the cutting of sheet material such as plasterboard and the like into uniform widths.

Plasterboard (often referred to as drywall or by the trade mark Gyprock) is sold in standard size sheets, typically of 4'×8' size. When plasterboard is installed as a wall cladding, it is often necessary to cut a strip of uniform width from a standard sheet, for example to provide a partial sheet for installation in a corner of a room. A professional installer will cut the strip using a utility knife in conjunction with a tape measure. Using his thumb, he will hold the end of the tape measure against the side of the utility knife, extend the tape across the sheet, and hold the tape reel against the edge of the sheet. With the reel held in one hand and the knife in the other, the installer will simultaneously slide both hands down the sheet so that the knife will score a line parallel to the edge. The tape measure is then discarded and a final cut is made along the score line using the knife. The strip to be cut off is then bent with respect to the remainder of the sheet until it snaps along the cut line. Generally, it would not be possible for the installer to apply sufficient pressure to the knife to make the required cut in one pass.

It will be appreciated that this operation is somewhat inconvenient and is time consuming in that two passes with the knife are required. If the installer presses too hard with the knife on the first pass, there is the risk that an inaccurate cut will be made or that the operator may injure himself on the knife blade. There is also the problem that the tape measure may slip.

U.S. Pat. No. 2,952,025 Johnson, discloses a utility knife having a built-in tape measure for facilitating cutting of plasterboard sheets and the like in the manner discussed above. So far as is known, the Johnson device is not commercially available. However, it is thought that the device would be expensive to manufacture and somewhat cumbersome. Also, there would be the disadvantage that the tape measure could not conveniently be used other than in association with the knife.

The United States patent literature also includes the following examples of patents relating to tape measures associated with scissors for facilitating similar cutting operations on fabrics and the like: U.S. Pat. Nos. 786,646 (J. Johnson); 1,218,798 (Nelson); 2,023,408 (Coll); 2,023,409 (Coll); 2,952,025 (F. H. Johnson).

It is an object of the present invention to provide an attachment for a utility knife which permits a tape to be directly coupled to the knife for facilitating cutting of plasterboard and the like.

According to the invention the attachment is intended to be used with a utility knife of the type which includes a handle comprising first and second separable handle parts defining there between a slot at an end of the handle for receiving a replaceable blade of relatively thin plate form having an outer end portion formed with a cutting edge. Means is provided for retaining the blade in the slot with said outer end portion of the blade protruding from the handle. Means is also provided for removably coupling the handle parts together so as to permit replacement of the blade. The attachment has a first portion of relatively thin plate form adapted to overlie at least a portion of the blade within the slot and projecting outwardly of the slot alongside the blade, and a second portion coupled to the first portion externally of the slot but inwardly of the blade cutting edge. The second portion projects outwardly away from the blade and is formed with an opening adapted to receive an end fitment of a measuring tape so that the tape can be coupled to the knife and will extend laterally therefrom generally normal to the blade.

In order that the invention may be more clearly understood, reference will now be made to accompanying drawings which illustrate a preferred embodiment of the invention by way of example, and in which, FIG. 1 is a perspective view from one side of a utility knife fitted with an attachment according to the invention;

Figure 1:
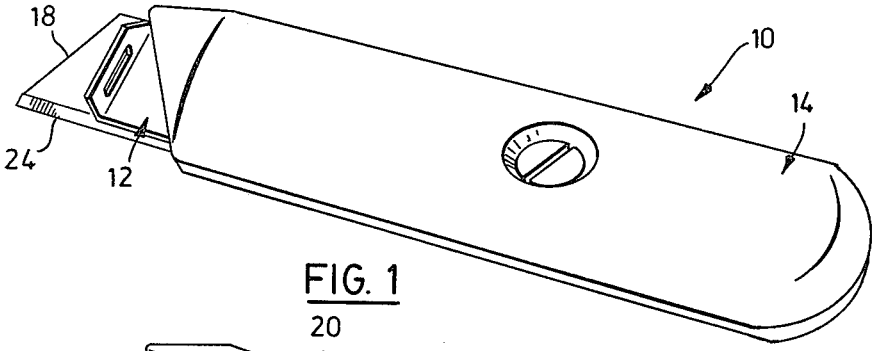
Figure 2:
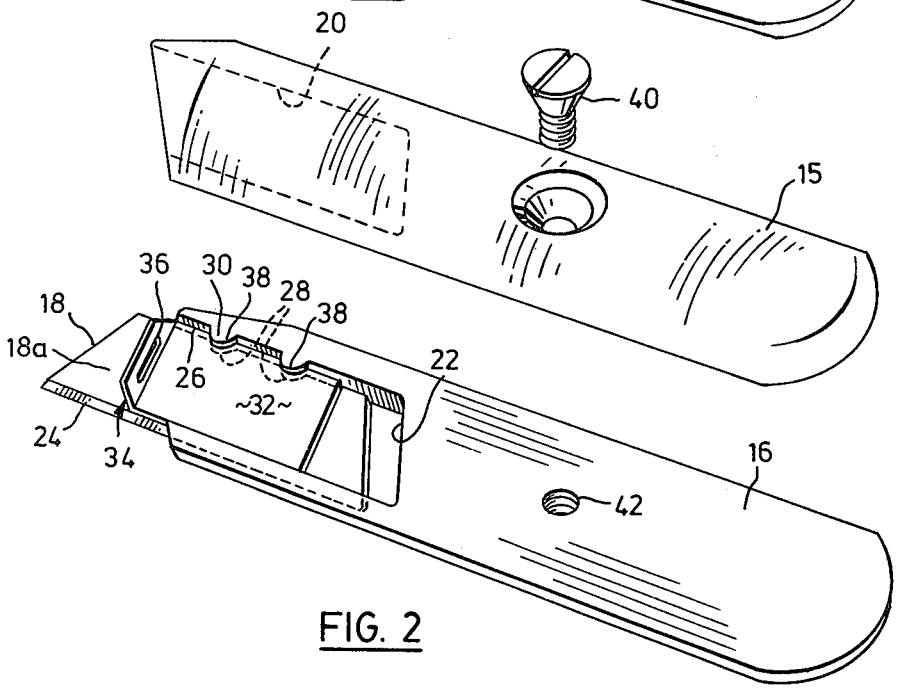
FIG. 2 is an exploded perspective view corresponding to FIG. 1.

Referring first to FIG. 1, a utility knife is generally indicated at 10 and is fitted with an attachment 12 of the form provided by an invention. Knife 10 includes a handle 14 made up of first and second separable handle parts 15 and 16 (FIG. 2). The handle parts define therebetween a slot which receives a replaceable blade 18. In this particular embodiment, the slot is defined by respective recesses 20 and 22 on the inner faces of the handle parts 15 and 16, which recesses cooperate to define the slot when the parts are fitted together. Blade 18 is shown disposed in recess 22 in handle part 16 in FIG. 2 and it will of course be understood that recess 20 will overlie the blade when the two handle parts are coupled together.

Blade 18 is of conventional form and is of trapezoidal shape having a cutting edge 24 which extends along the longer of the two longitudinal blade edges as seen fitted into the handle 12, the blade has an outer end portion **18*a* formed with part of cutting edge 24. The shorter longitudinal edge 26 of the blade is formed with a pair of spaced semi-circular recesses 28 either of which can cooperate with means designed to retain the blade in the slot with its outer end portion 18*a* protruding from the handle. In this particular embodiment, these means are represented by a fixed projection 30 which extends into the recess 22 in handle part 16 for engagement in one of the blade recesses. Projection 30 is cast as part of handle part 16 as is conventional in utility knives. It will be appreciated that the longitudinal position of blade 18, and hence the extent to which the blade protrudes from the handle can be adjusted so that either of the recesses 28 selectively cooperates with projection 30**.

The attachment 12 is best seen in FIG. 2. It comprises a first portion 32 of relatively thin plate form adapted to overlie at least a portion of the blade within the slot in the handle of the utility knife, and to project outwardly of the slot alongside the blade. Coupled to portion 32 externally of the slot but inwardly of the blade is a second portion 34 of the attachment which projects away from the blade and is formed with an opening 36 adapted to receive and end fitment on a measuring tape as will be more specifically described in connection with FIG. 3. In this particular embodiment, the second portion 34 of attachment 12 comprises a flange formed integrally with the first portion 32 and disposed substantially at right angles with respect to portion 32. Thus, the attachment is formed in one piece from a single relatively thin and flat metal strip having an upturned flange at one end.

The first portion 32 of attachment 12 is of generally rectangular shape and is formed in each of its two longitudinal edges with a pair of spaced semi-circular recesses 38 similar to the recesses 28 in blade 18. Thus, the attachment can be appropriately positioned in the slot in the handle of the utility knife with one of its recesses 38 in cooperation with the projection 30 used for retaining the blade, so that the attachment is also retained against movement outwardly of the slot. Although it would be possible to provide the recesses 38 in one edge only of the attachment, the recesses are preferably provided in both edges so that the attachment can if necessary be reversed to suit either a left or right handed user.

The handle part 15 and 16 of the utility knife can be coupled together by a screw 40 which extends through an opening in part 15 and which is received in a screw-threaded boss 42 in part 16. When the parts 15 and 16 are placed in overlying cooperating relationship, screw 40 can be tightened to firmly draw the two parts together. Ordinarily, the width of the slot defined between the two handle parts will be sufficient to accomodate attachment 12. However, it will be appreciated that, even in the event that the blade 18 is a snug fit in the slot, screw 40 will allow the handle part to accomodate the additional thickness represented by the attachment. In practice, the screw will be tightened to an extent sufficient to ensure a firm clamping of both the blade 18 and the attachment 12.

As noted above, the flange which represents the second portion 34 of the attachment extends generally normally with respect to portion 32. It too is of relatively thin plate form and has chamfered outer corners for safety. The opening 36 is in the form of a rectangular slot disposed generally parallel both to the portion 32 of the attachment and to blade 18. It will also be noted that the fold line between the two portions 32 and 34 of the attachment extends generally normal to the longitudinal edges of the attachment. These two characteristics of the flange ensure that, when the knife is in use, and is disposed at a normal attitude with respect to the material being cut, the flange will be disposed generally parallel to the surface of the material and slot 36 will be disposed so that the tape extends laterally away from the knife generally normal to blade 18.

Figure 3:
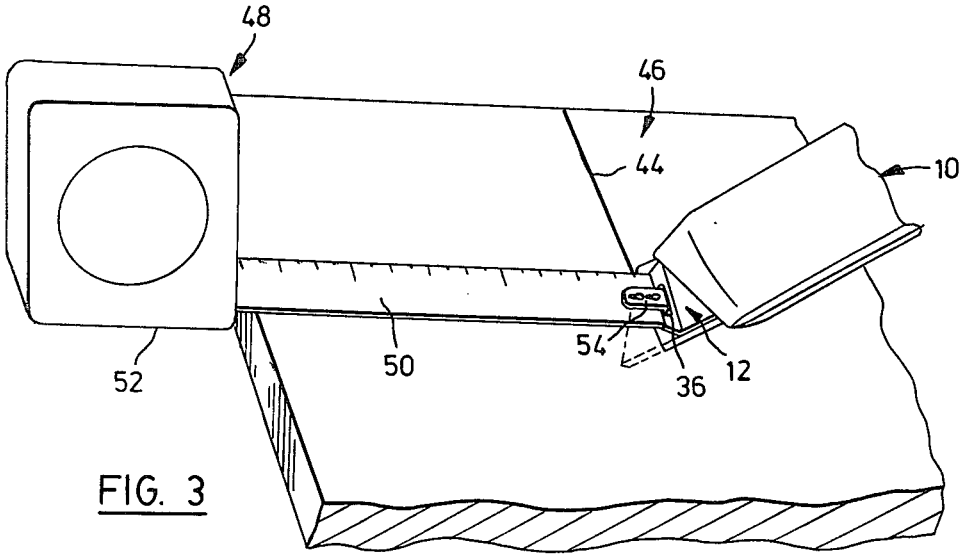
FIG. 3 is a perspective view showing the knife and attachment of FIGS. 1 and 2 in the use in association with a measuring tape.

This is best illustrated in FIG. 3 where the knife is shown at 10 in a normal attitude it would assume in forming a cut 44 in, say, a sheet of plasterboard 46. A measuring tape 48 of conventional form is shown in association with the knife 10. The tape includes a tape member 50 which can be unreeled from a casing 52 and which has a right angular end fitment 54 at its outer end. Fitment 54 is shown engaged downwardly through the opening 36 in the attachment 12 associated with knife 10. Thus, in use, the end fitment of the measuring tape is engaged with the opening and the tape is extended to a length appropriate to the required cut to be made. Preferably, the tape housing 52 has associated therewith a device for locking the tape against unreeling although this is not essential. In any event, with the tape housing 52 abutted against the edge of the sheet 46, the tape housing 52 is held in the user's left hand while knife 10 is grasped in his right hand. The housing and knife will then move downwardly together while the knife is pressed against the sheet so as to form the cut 44. It has been found in practice that, where sheet 46 is a sheet of plasterboard of say ½ inch thickness, sufficient pressure can be exerted on the knife 10 to form an adequate cut in a single pass to permit the sheet to be subsequently broken along line 44.

It will be appreciated that the attachment provided by the invention will present significant advantages, particularly to a professional dry wall installer who must cut numerous sheets of plasterboard during the course of a single working day. Also, the attachment will be relatively inexpensive to manufacture and will be safe to use.

It will also be appreciated that the preceding description relates to a specific embodiment of the invention and that many modifications are possible. For example, it is not essential that the attachment be made from a single sheet of metal. In an alternative embodiment, the second portion of the attachment, to which the tape is fitted, could be formed by an arcuate length of wire. The first portion of the attachment need not be of the same width as the knife blade and does not have to have the recesses 38. In another embodiment, the attachment could simply be clamped between the blade and the relevant part of the knife handle. In an alternative embodiment, the attachment could be made of a plastic material (e.g. nylon).

It should also be noted that the term "utility knife" as used here and is intended to denote any form of knife within the terms of the definition set forth in the accompanying claims. The drawings show one particular form of knife in which the blade is held in a fixed position in the handle although it is to be understood that the attachment may also be used with the type of knife which has a blade capable of being lonitudinally adjusted to vary the amount by which the blade protrudes from the handle.

I claim:

1. An attachment for a utility knife of the type which includes a handle comprising first and second separable handle parts defining there between a slot at an end of the handle for receiving a replaceable blade of relatively thin plate form having an outer end portion formed with a cutting edge, means retaining the blade in said slot with said outer end portion protruding from the handle, and means removably coupling the handle parts together so as to permit replacement of the blade, the attachment comprising a first portion of relatively thin plate form adapted overlie at least a portion of the knife blade within said slot and projecting outwardly of said slot alongside the blade, and a second portion coupled to said first portion externally of the slot but inwardly of the outer end of the blade, said second portion projecting outwardly away from the blade and being formed with an opening adapted to receive an end fitment of a measuring tape so that the tape can be coupled to the knife and extend laterally therefrom generally normal to the blade.

2. An attachment as claimed in claim 1, wherein said first portion is adapted to cooperate with said blade retaining means whereby the attachment is located longitudinally with respect to said blade.

3. An attachment as claimed in claim 2, wherein said blade includes a parallel sided portion inside the slot formed in an edge thereof with a plurality of longitudinally spaced recesses, wherein said retaining means comprises a fixed projection inside the handle selectively engageable in one of said recesses in the blade, and wherein said first portion of the attachment is parallel sided and of substantially the same transverse dimension as the blade and is formed in an edge thereof with a plurality of spaced recesses engageable with said projection whereby the attachment is retained against longitudinal and lateral movement.

4. An attachment as claimed in claim 3, wherein said first portion of the attachment is provided with said recesses in both longitudinal edges thereof so that the attachment is reversable.

5. An attachment as claimed in claim 1, wherein said second portion comprises a flanged formed integrally with said first portion of the attachment, and wherein said opening in the second portion comprises a generally rectangular slot disposed parallel to both said first portion of the attachment and to said blade.

6. An attachment as claimed in claim 5, formed in one piece from a single strip of relatively thin metal plate.

7. In a utility knife of the type which includes a handle comprising first and second separable handle parts defining there between a slot at an end of the handle for receiving a replaceable blade of relatively thin plate form having an outer end portion formed with a cutting edge, means retaining the blade in said slot with said outer end portion protruding from the handle, and means removably coupling the handle parts together so as to permit replacement of the blade;

the improvement comprising an attachment for permitting a measuring tape to be coupled to said knife, the attachment including a first portion of relatively thin plate form overlying a portion of said blade within the slot and projecting outwardly of said slot alongside the blade, and a second portion coupled to said first portion externally of the slot but inwardly of the outer end of the blade, said second portion projecting outwardly away from the blade and being formed with an opening adapted to receive an end fitment of a measuring tape so that the tape can be coupled to the knife and will extend laterally therefrom generally normal to the blade.

* * * * *